US005339545A

United States Patent [19]

Paris

[11] Patent Number: 5,339,545

[45] Date of Patent: Aug. 23, 1994

[54] SKI BOOT LINER

[75] Inventor: Jean Paris, Sevrier, France

[73] Assignee: Salomon S.A., Annecy Cedex, France

[21] Appl. No.: 54,296

[22] Filed: Apr. 30, 1993

[30] Foreign Application Priority Data

May 6, 1992 [FR] France ..... 92 05825

[51] Int. Cl.[5] ..... A43B 5/04

[52] U.S. Cl. ..... 36/119; 36/55

[58] Field of Search ..... 36/88, 93, 119, 55, 36/10, 71, 89, 117

[56] References Cited

U.S. PATENT DOCUMENTS

| | | | |
|---|---|---|---|
| 387,035 | 7/1888 | Basch | 36/55 X |
| 1,885,327 | 11/1932 | Burnham | 36/55 X |
| 3,613,271 | 10/1971 | Geller | 36/119 |
| 3,750,310 | 8/1973 | Messner et al. | 36/119 X |
| 3,858,337 | 1/1975 | Vogel | 36/119 X |
| 3,977,098 | 8/1976 | Chalmers | 36/71 X |
| 4,019,266 | 4/1977 | Hanson et al. | 36/119 |
| 4,078,322 | 3/1978 | Dalebout | 36/10 X |
| 4,095,355 | 6/1978 | Annovi | 36/118 |
| 4,154,009 | 5/1979 | Kubelka et al. | 36/119 |
| 4,301,564 | 11/1981 | Dalebout | 36/93 X |
| 4,385,456 | 5/1983 | Livernois et al. | 36/71 X |
| 4,920,666 | 5/1990 | Marega | 36/10 X |
| 5,050,319 | 9/1991 | Perotto | 36/117 |
| 5,067,257 | 11/1991 | Coomer | 36/88 X |
| 5,133,088 | 7/1992 | Dunlap | 36/10 X |

FOREIGN PATENT DOCUMENTS

| | | | |
|---|---|---|---|
| 1066049 | 11/1979 | Canada . | |
| 0107841 | 5/1984 | European Pat. Off. | 36/119 |
| 0370948 | 5/1990 | European Pat. Off. . | |
| 2336892 | 7/1977 | France . | |
| 2360271 | 3/1978 | France . | |
| 626793 | 12/1981 | Switzerland . | |
| 0654467 | 2/1986 | Switzerland | 36/119 |

*Primary Examiner*—Paul T. Sewell
*Assistant Examiner*—Ted Kavanaugh
*Attorney, Agent, or Firm*—Sandler, Greenblum & Bernstein

[57] ABSTRACT

Internal liner for insertion between the lower part of the leg and the foot of a skier and a shell of a sports boot such as an alpine ski boot, such liner including a vamp enveloping the foot which is overlaid by an upper enveloping the lower part of the leg and constituted by a rear portion and a front portion respectively forming a rear wedge and a front wedge joined to constitute a wall having a given thickness adapted to play an adjusting role for the footwear between the internal surface of the shell of the boot and the lower part of the leg, wherein it is constituted by a sock extending uniformly and without folds, and having, at least in one stretchable zone, a plurality of distinct and juxtaposed wedging elements fixed externally thereon to constitute the wall of the liner having a given thickness and compressibility.

20 Claims, 2 Drawing Sheets

SKI BOOT LINER

BACKGROUND OF THE INVENTION

1. Field of the Invention

The present invention is related to an internal liner inserted between the lower part of the leg and the foot of a skier and a shell of a sports boot such as an alpine ski boot, such liner comprising a vamp enveloping the foot which is overlaid by an upper enveloping the lower part of the leg and constituted by a rear portion and a front portion respectively forming a rear wedge and a front wedge, that are joined to constitute a wall having a given thickness, adapted to play an adjustment role for the footwear between the internal surface of the shell of the boot and the lower part of the leg.

2. Discussion of Background and Relevant Information

Liners of the above-mentioned type are known, the walls thereof, especially the walls of the upper, being constituted of an elastic material, for example, polyurethane, providing a certain general comfort, but whose main disadvantage lies in the fact that it requires the provision of a covering tongue of an opening for entry of the foot.

Such a tongue not only complicates the manufacture of the liner itself, but in addition, runs the risk of constituting an excess thickness by lateral sliding during skiing and thus creating compression points that are incompatible with the comfort desired.

To overcome this disadvantage, French Patent Publication No. 2,360,271 discloses an internal liner whose ascending upper is closed along its entire periphery, and has greater circumferential stretching ability than the other portions.

For this, the wall is divided into strips which extend transversely with respect to the circumference and which are alternately contiguous, like an accordion.

Thus, the liner can expand to enable passage of the foot by a deployment of the accordion-shaped strips forming a type of bellows.

Such a design, however, has a number of disadvantages because by stretching the strips, the thickness of the wall of the liner is varied, and in addition, the wall is provided with a flexibility which is not forcibly desired, especially at the rear portion of the liner which should constitute a firm support against the shell of the boot.

Moreover, this deployment of the strips causes an effect which runs counter to the corpulence of the skier. Indeed, if the skier is heavy, he or she would tend to cause the stretching of the accordion-shaped strips and as such, reduce their resistance, whereas under such circumstances, it would be preferable to reinforce such resistance, and vice versa.

Further, such a design implies use of a material having the same nature. However, experience has proved that a liner that is both comfortable and efficient during skiing should enable a relatively firm rear support as well as a front support in flexion, as per the degree of flexibility selected in accordance with the comfort desired.

Other boots are also known whose internal are liners made of polyurethane and which have, on their external surfaces at least, projections enabling one to determine, in accordance with their number, the portions of the liner whose degree of flexibility is differentiated. French Patent Publication No. 2,336,892 describes a liner of this type. According to this document, the differentiation in flexibility, without however changing the density of the polyurethane which constitutes the wall of the liner, aims at enabling certain portions of the liner to bear different tensions and/or to transmit such tensions differently to the external shell of the boot. As is clear, since the liner is obtained in a single piece including the projections, its adaptation to the foot of the skier occurs due to the flexibility from an initial fitting volume, determined for a foot size. Thus, for a foot that is relatively small in volume, the wall of the liner is not stretched or is only slightly stretched, even in the projections area, thus causing a variation in the flexibility and initial firmness of all the liner portions, whether or not they are provided with projections. It should be noted in this regard that the stretching of the wall does not cause a lessening of the flexibility thereof, but increases its resistance to compressibility, which would appear to be satisfactory. However, due to the fact that there is no exact correlation between, on the one hand, the corpulence, the weight and/or the strength of the skier and, on the other hand, the volume of the feet of the skier, this increase in resistance to compressibility of the wall can be excessive or inadequate.

SUMMARY OF THE INVENTION

It is an object of the present invention to achieve not only this result, but also to obtain a compromise between a controlled compressibility of the thickness of the liner, possibly different as per the zones, independently of a transverse elastic extension of the upper to enable passage of the foot without using a removable or retractable tongue.

To achieve this object, wherein the constant density and lift are not influenced by the stretching or retraction of the liner, the liner is designed from two basically distinct components, one of them constituting the lifting and/or support element called "wedge" and the other being stretchable, constituting the element for enveloping the foot and the support element of the lifting element, obtained from a plurality of "wedging" elements.

To this end, the invention is related to an internal liner inserted between the lower part of the leg and the foot of a skier and a shell of a sports boot such as an alpine ski boot, such liner comprising a vamp enveloping the foot which is overlaid by an upper enveloping the lower part of the leg and constituted by a rear portion and a front portion respectively forming a rear wedge and a front wedge, joined to constitute a wall having a given thickness adapted to play an adjusting role for the footwear between the internal surface of the shell of the boot and the lower part of the leg characterized in that it is constituted by a flexible comfort liner or sock, extending uniformly and continuously without folds, and having at least in one stretchable zone, a plurality of distinct and juxtaposed wedging elements fixed externally thereon to constitute the wall of the liner having a given thickness and compressibility.

According to one embodiment, the stretchable zone extends at least in the zone corresponding to the flexion fold and the instep of the foot of the skier.

According to one characteristic of the invention, the comfort sock is obtained of a relatively stretchable elastic material, capable of constituting a grid, a fabric and/or a membrane which has less thickness, whose passage from the resting position to the stretched position on the foot does not cause any substantial variation with respect to its thickness. This sock can advantageously be covered by an impervious film.

According to another characteristic of the invention, the initial fitting volume of the sock at rest, with respect to the stretchable zone bearing the wedging elements, is less than the internal theoretical volume of the liner for a given foot size such that the introduction of the foot of the user (skier) causes the extension of said sock, and consequently, the distancing of the wedging elements without affecting them.

BRIEF DESCRIPTION OF THE DRAWINGS

The invention will be better understood and other characteristics thereof will become clearer upon reading the description that follows, with reference to the annexed schematic drawings, illustrating, as non-limiting examples, how the invention can be obtained and wherein.

DETAILED DESCRIPTION OF THE PREFERRED EMBODIMENTS

Figure 1:
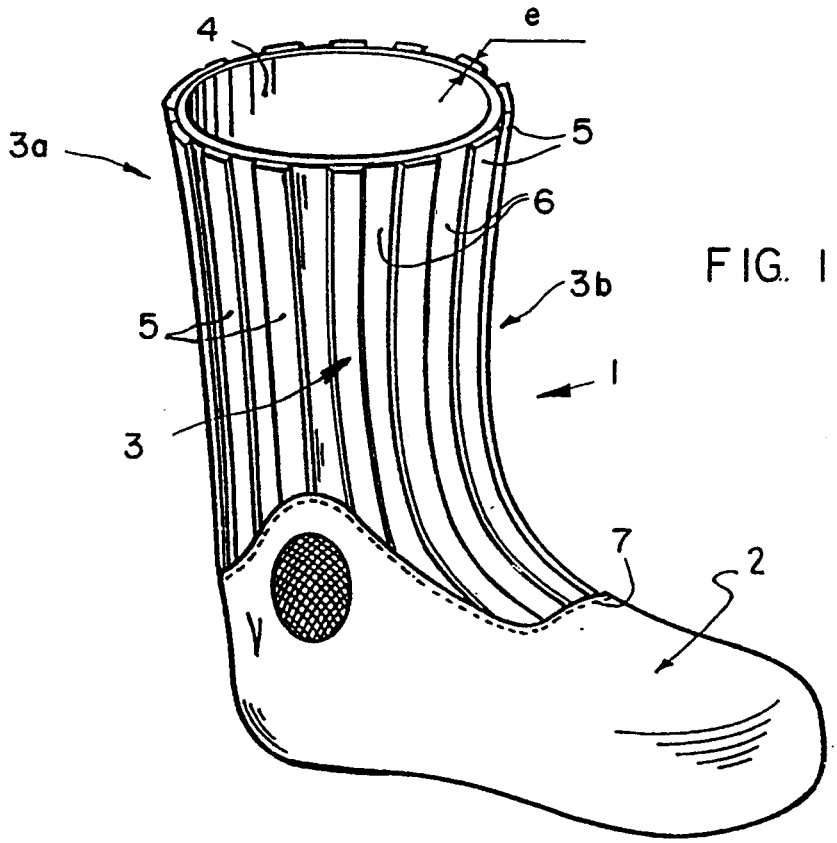
FIG. 1 represents, in a perspective view, a liner as per a first embodiment of the invention.

Liner 1, designated in its entirety and represented in FIG. 1, is adapted to be inserted between the lower part of the leg and the foot of a skier and a shell of a ski boot (not represented).

Liner 1 comprises a vamp 2, enveloping the foot, which is overlaid by an upper 3, enveloping the lower part of the leg, and constituted of a rear portion 3*a* and a front portion 3*b* respectively forming a rear wedge or spacer and a front wedge or spacer, joined to constitute a wall having a given thickness "e", adapted to play an adjusting role for the footwear between the internal surface of the shell of the boot and the lower part of the leg.

According to a first embodiment of the invention, liner 1 comprises a sock 4 extending uniformly and without folds, and stretchable at least in the zone of upper 3, and on which sock 4 is fixed externally distinct and juxtaposed wedging or space elements 5, to constitute the wall having a thickness "e" of a liner 1 having a given compressibility.

Figure 4:
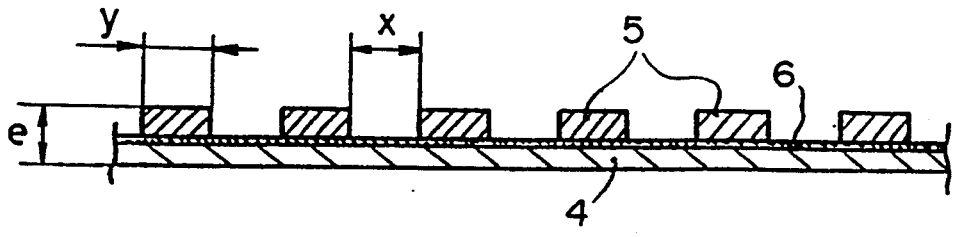
FIG. 4 schematically illustrates a transverse section of a liner upper as per FIGS. 1 and 2 provided with wedging elements as per the invention.

As per the present example, the wedging elements 5 are constituted by small quadrangular bars (FIG. 4) which extend in the longitudinal direction of the ankle-foot axis. These bars have a width "y" and are spaced apart by value "x", such values "y" and "x" being capable of being constant or variable depending on the filling zones to be filled between the foot and the internal wall of the shell of the boot or, depending on a specific effect desired on a predetermined zone of the liner.

In a variation, the wedging elements could be arranged in the transverse direction.

Figure 3:
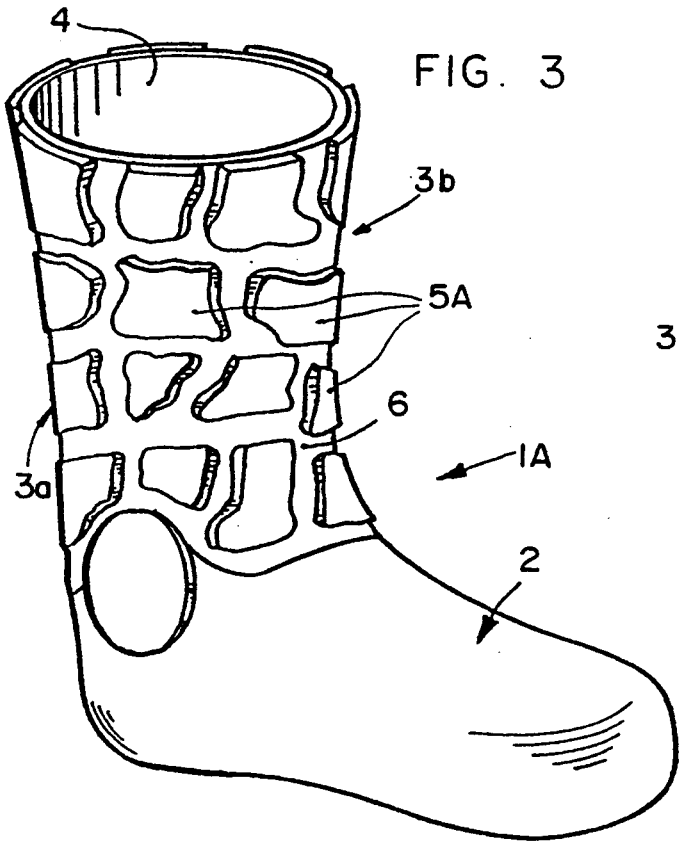
FIG. 3 represents, in a perspective view, a liner as per a second embodiment of the invention.

As can be seen especially clearly in FIG. 3, upper 3 is constituted by sock 4, obtained of a stretchable fabric covered with an impervious film 6, also stretchable, on which are located the wedging elements 5.

It must also be noted that vamp 2 forming the lower portion of liner 1 does not have elements 5, but can be provided therewith without leaving the scope of the invention.

The two portions, namely, the high upper 3 and vamp 2, are connected to each other by stitching 7.

Thus, in accordance with what is mentioned previously, the initial fitting volume of sock 4 at rest, with respect to the stretchable zone bearing wedging elements 5, 5A, 5B, 5C, 5D, is less than the theoretical internal volume of liner 1, 1A, 1B for a given shoe size, such that the introduction of the foot of the user causes the extension of sock 4 and consequently an increased spacing of the elements 5, 5A, 5B, 5C, 5D without affecting them.

As per another characteristic of the invention, the wedging elements 5 are either attached by adhesion on the impervious film 6, or formed unitarily thereon.

The wedging elements 5 are, for example, obtained of a material having the same density, but according to the zone in which they are located, they can also be obtained of materials having different densities.

The rear portion of the upper constituting a rear support wedge 3*a* of the lower part of the leg against the shell of the boot, is constituted by wedging elements 5, 5A, 5B, 5C, 5D preferably obtained of a high density material not easily deformable, or non-deformable, whereas its front portion constituting a front support wedge 3*b* is constituted by wedging elements 5, 5A, 5B, 5C, 5D obtained of an elastically compressible material.

This enables the front portions 3*b* of liner 1 to be adapted in accordance with their location.

In fact, for the rear portion, a rigid support would be preferred, by virtue of a non-deformable material, whereas for the front portion, which has to participate in flexion control, a more flexible material is preferred.

The latter material can be of the visco-elastic type having an appropriate density, for example, a polyurethane foam.

In order to eliminate the discontinuous effect of wedging elements 5, the sum of their bearing surfaces is calculated accordingly.

Figure 2:
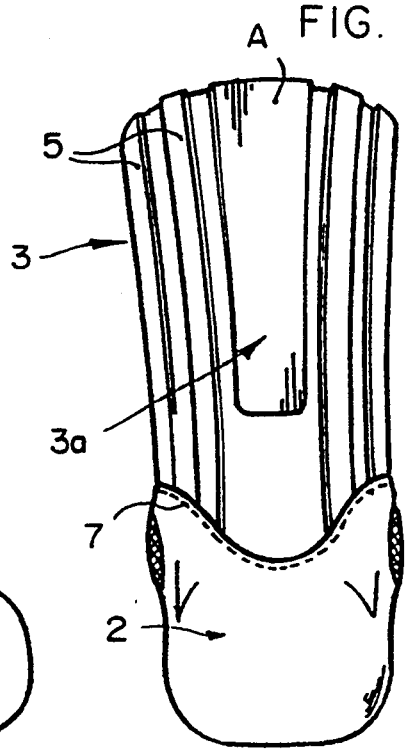
FIG. 2 represents a variation of the embodiment of a liner as per FIG. 1 seen from the rear.

According to a variation visible in FIG. 2, the rear portion 3*a* of upper 3 of liner 1 comprises a smooth zone A, actually a portion of sock 4, from which the series of wedging elements 5 are absent, but which is provided with a single wedging element to offer a firm support of the rear portion of the lower part of the leg against the rigid shell of the boot. This single wedging element has, to this end, a relatively extended support surface.

According to a second embodiment of the invention, liner 1A represented in FIG. 3 mainly differs from the previous embodiment in the shape and arrangement of the wedging elements 5A which are constituted by the plurality of plates having disparate shapes.

Figure 5:
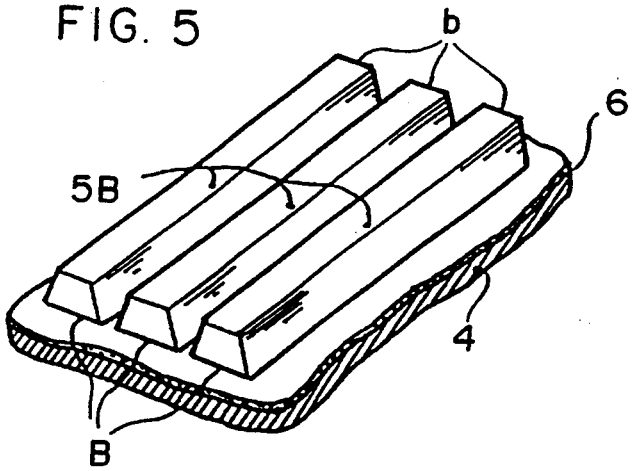
FIGS. 5 and 6 respectively illustrate, in a partial perspective view and a transverse sectional view, wedging elements as per a variation of the embodiment.

According to the example represented in FIG. 5, the wedging elements 5B, which are different from the previous elements 5 in that they have a trapezoidal section, are arranged in parallel on sock 4 by their larger base B.

Figure 6:
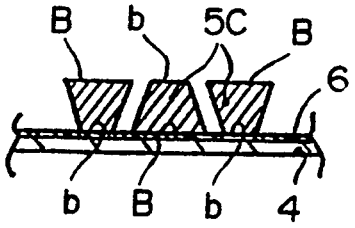

The wedging elements 5C represented in FIG. 6 have sections that are identical to those of elements 5B, except that they are located alternately on their larger base "B" and on their smaller base "b".

Figure 7:
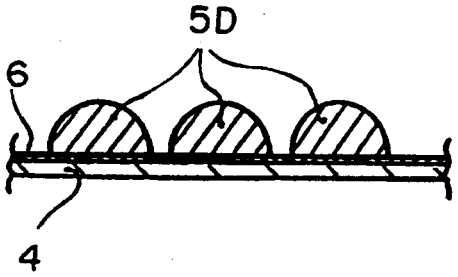
FIG. 7 shows, in a transverse section, wedging elements as per a variation of the embodiment.
Figure 8:
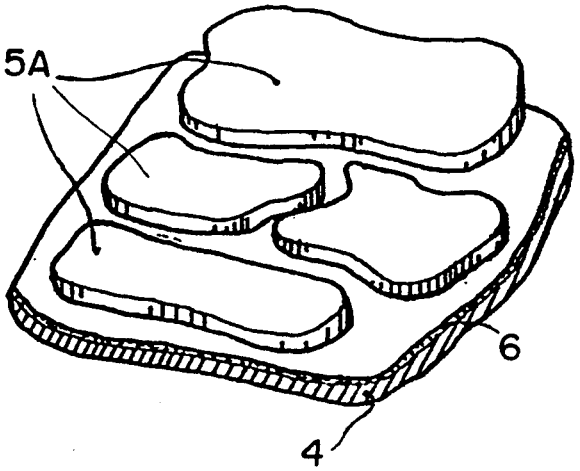
FIG. 8 shows, in a partial enlarged perspective view, wedging elements as per the variation of the embodiment corresponding to the second example of FIG. 3.

As per the example represented in FIG. 7, the wedging elements 5D differ from the previous elements 5, 5B, 5C in that they have an approximately semi-circular section.

Therefore, as per the previous description, a stretchable liner is obtained when the foot is inserted in the boot, the liner getting tightened thereafter, on the lower part of the leg of the skier, without folds, once it is put on. Such a liner has, at the level of its high upper, thicknesses and bearing surfaces that are compatible with the comfort, the rigid external structure and the tightening forces desired. In addition, the liner is practical to put on, impervious and has no superposition of edges, which would adversely affect comfort or blood circulation.

The instant application is based upon French patent application 92.05825 of May 6, 1992, the disclosure of which is hereby expressly incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed is:

1. An internal liner of a sports boot, for insertion between a shell of the sports boot and the lower portion of the leg and foot inserted within the liner, said liner comprising:

a vamp for enveloping the foot;

an upper affixed to the vamp for enveloping the lower portion of the leg, said upper comprising a rear portion and a front portion, said front portion and said rear portion including a wall having a predeterminate thickness and being adapted to provide an adjustment for the sports boot between an internal surface of the sports boot and the lower portion of the leg;

said upper comprising an elastic sock extending uniformly and continuously around the lower portion of the leg, said elastic sock not having a tongue, said sock having an external surface, said upper having a stretchable zone and a plurality of distinct and spaced apart wedging elements extending outwardly from said external surface of said sock, said wedging elements having a predeterminate thickness and a predeterminate compressibility wherein said stretchable zone consists of said upper; and no wedging elements are positioned on said vamp.

2. An internal liner according to claim 1, wherein:

said elastic sock, without a foot inserted therein, provides an initial internal volume;

said elastic sock, with a foot inserted therein, provides an increased internal volume whereby, at said stretchable zone, said wedging elements are spaced apart by increased distances but are not affected.

3. An internal liner according to claim 1, wherein:

said stretchable zone is constituted by a stretchable fabric covered by an impervious film, said wedging elements extending outwardly from said impervious film.

4. An internal liner according to claim 3, wherein:

said wedging elements are secured to said impervious film by means of an adhesive.

5. An internal liner according to claim 3, wherein:

said wedging elements are formed unitarily with said impervious film.

6. An internal liner according to claim 1, wherein:

said wedging elements are constituted by small bars extending along an ankle-foot axis.

7. An internal liner according to claim 1, wherein:

said wedging elements are constituted by small bars extending transversely of an ankle-foot axis.

8. An internal liner according to claim 1, wherein:

said wedging elements are constituted by a plurality of plates having disparate shapes.

9. An internal liner according to claim 1, wherein:

each of said wedging elements has an identical density.

10. An internal liner according to claim 1, wherein:

predetermined ones of said wedging elements have different densities.

11. An internal liner according to claim 1, wherein:

said rear portion of said upper has a plurality of said wedging elements having a predetermined density and a predetermined compressibility; and said front portion of said upper has a plurality of said wedging elements having a density less than said predetermined density and having an elastic compressibility greater than said predetermined compressibility.

12. An internal liner according to claim 11, wherein:

said plurality of said wedging elements of said rear portion of said upper are not deformable.

13. An internal liner according to claim 1, wherein:

said wedging elements are visco-elastic.

14. An internal liner according to claim 1, wherein:

said wedging elements are comprised of polyurethane foam.

15. An internal liner according to claim 1, wherein:

said plurality of wedging elements comprises a plurality of bearing surfaces, said bearing surfaces collectively constituting a bearing surface area for eliminating a discontinuous effect of said wedging elements.

16. An internal liner according to claim 1, wherein:

said upper is unitary.

17. An internal liner according to claim 1, wherein:

said rear portion of said upper is provided with only with a single wedging element for providing a firth support for the lower portion of the leg against the shell of the sports boot.

18. An internal liner according to claim 1 in combination with said sports boot.

19. An internal liner according to claim 18, wherein:

said sports boot comprises a ski boot, said ski boot having a flexion area above a foot instep area; and said stretchable zone extends at least in an area of said liner corresponding to said flexion area of said sports boot.

20. An internal liner according to claim 1, wherein:

said stretchable zone is constituted by the entirety of said upper.

* * * * *